US006465955B1

(12) United States Patent
Kraus et al.

(10) Patent No.: US 6,465,955 B1
(45) Date of Patent: Oct. 15, 2002

(54) GAS DISCHARGE LAMP

(75) Inventors: Albrecht Kraus, Kerkrade (NL); Bernd Rausenberger, Aachen (DE); Horst Dannert, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/545,786

(22) Filed: Apr. 7, 2000

(30) Foreign Application Priority Data

Apr. 7, 1999 (DE) ..... 199 15 617

(51) Int. Cl.[7] ..... H01J 11/00
(52) U.S. Cl. ..... 313/567; 313/234; 313/607
(58) Field of Search ..... 313/567, 491, 313/574, 572, 623, 624, 633, 630, 607, 493, 236, 634

(56) References Cited

U.S. PATENT DOCUMENTS

| | | | | |
|---|---|---|---|---|
| 2,624,858 A | | 1/1953 | Greenlee | 313/201 |
| 5,013,966 A | * | 5/1991 | Saikatsu et al. | 313/493 |
| 5,654,606 A | * | 8/1997 | Weijtens et al. | 313/491 |
| 5,720,859 A | * | 2/1998 | Czubarrow et al. | 204/157.43 |
| 6,191,539 B1 | * | 2/2001 | Green | 315/249 |

FOREIGN PATENT DOCUMENTS

JP 09040462 A * 2/1999

* cited by examiner

*Primary Examiner*—Vip Patel
*Assistant Examiner*—Joseph Williams
(74) *Attorney, Agent, or Firm*—Frank Keegan

(57) ABSTRACT

A gas discharge lamp has at least one capacitive electrode of a dielectric material having a dielectric saturation polarization P and an effective surface A wherein the product of $P \cdot A > 10^{-5}$ C. This lamp can be operated without drive electronics or a ballast, using power available at private households.

28 Claims, 2 Drawing Sheets

GAS DISCHARGE LAMP

BACKGROUND OF THE INVENTION

The invention relates to a gas discharge lamp comprising at least one capacitive electrode.

Known gas discharge lamps are composed of a vessel containing a filling gas, wherein the gas discharge takes place, and of generally two metallic electrodes which are sealed in the discharge vessel. An electrode supplies the electrons for the discharge, which electrons are subsequently supplied to the external electric circuit via the second electrode. The donation of electrons generally takes place via thermionic emission (hot electrodes), although it may alternatively be brought about by emission in a strong electric field or, directly, via ion bombardment (ion-induced secondary emission) (cold electrodes). In an inductive mode of operation, the charge carriers are generated directly in the gas volume by means of an electromagnetic alternating field of high frequency (typically above 1 MHz in low-pressure gas discharge lamps). The electrons follow circular paths within the discharge vessel, customary electrodes being absent in this mode of operation. In a capacitive mode of operation, capacitive electrodes are used electrodes. These electrodes are embodied so as to be insulators (dielectric materials), which, on one side, are in contact with the gas discharge and, on the other side, are electroconductively connected (for example by means of a metallic contact) with an external electric circuit. When an alternating voltage is applied to the capacitive electrodes, an electric alternating field is formed in the discharge vessel, and the charge carriers move on the linear electric fields of the alternating field. In the high-frequency range (>10 MHz), the capacitive lamps are similar to the inductive lamps, because in this range the charge carriers are also generated in the entire gas volume. The surface properties of the dielectric electrode are less important here (so-called $\alpha$-discharge mode). At lower frequencies, the capacitive lamps change their mode of operation, and the electrons which are important for the discharge must be originally emitted at the surface of the dielectric electrode and multiplied in a so-called cathode drop region to maintain the discharge. Consequently, the emission behavior of the dielectric material determines the functioning of the lamp (so-called $\gamma$-discharge mode).

A drawback of known gas discharge lamps is that they require drive electronics for their operation. The driver electronics serves to ignite the gas discharge of the lamp and supply a ballast for the operation of the lamp at an electric circuit. Without a suitable lamp ballast in an external electric circuit, the current in the gas discharge lamp would increase so strongly as a result of an increase of charge carriers in the gas volume of the discharge vessel, that the lamp would be rapidly destroyed.

Such gas discharge lamps are also disclosed in U.S. Pat. No. 2,624,858. A gas discharge lamp comprising capacitive electrodes is operated by means of a dielectric material having a high dielectric constant $\in>100$ (preferably $\in>2000$) at an operating frequency below 120 Hz. The external voltage must range between 500 V and 10,000 V. As a result, such a capacitive gas discharge lamp cannot be operated by means of line current for private households (230 V, 50 Hz), but instead requires a circuit comprising drive electronics.

SUMMARY OF THE INVENTION

In a gas discharge lamp in accordance with the invention, this object is achieved in that a dielectric is provided having a dielectric saturation polarization P and an effective surface A to form the capacitive electrode, with the product of $P \cdot A > 10^{-5}$ C. The gas discharge lamp in accordance with the invention comprises a known transparent discharge vessel containing a customary filling gas (for example, for low-pressure gas discharge lamps, an inert gas or an inert gas with mercury). The discharge vessel accommodates at least two spatially separated electrodes, at least one of which is a capacitive electrode. The inventive, capacitive electrode may also be combined with, for example, a metallic electrode. The dielectric of the capacitive electrode may be composed of one or more layers. For each of the dielectric layers, use is made of a material whose dielectric saturation polarization P and effective surface A (i.e. in contact with the plasma in the discharge vessel and with the electric contact) have values such that the product of $P \cdot A > 10^{-5}$ C. As a result, maximally the electric charge $Q=2P \cdot A$ can be transported in one period. In this case, it applies that, on the one hand, the maximum charge Q should be chosen so high that, at an operating frequency f, the mean current $Q \cdot F$ can flow, and, on the other hand, the lamp is provided with a suitable ballast by the maximum charge. For the dielectric of the capacitive electrode use is preferably made of materials having a saturation polarization $P > 10^{-5}$ C/cm$^2$ and an effective surface A of approximately 10 cm$^2$. Naturally, a plurality of further electrodes are conceivable, within the scope of the invention, which suitably combine the material property and geometry of the dielectric material.

Such a lamp can be operated, in particular, using line current for private households (for example 230 V/50 Hz), without a circuit comprising drive electronics.

These and other aspects of the invention will be apparent from and elucidated with reference to the embodiments described hereinafter.

DETAILED DESCRIPTION OF THE PREFERRED EMBODIMENTS

Figure 1:
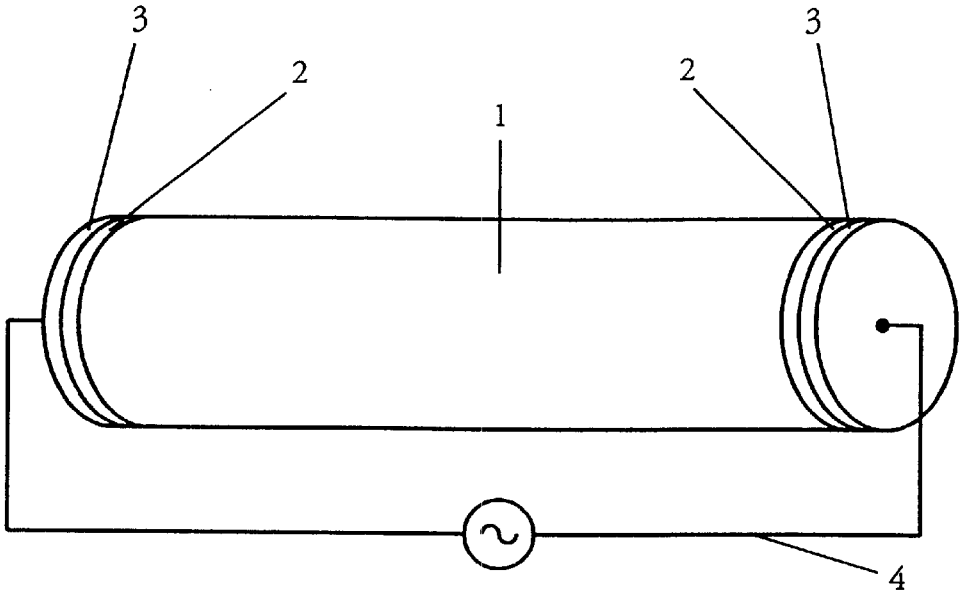
FIG. 1 diagrammatically shows a first embodiment of a gas discharge lamp in accordance with the invention.

In all examples, the starting material used for the dielectric is a dielectric solid. For the dielectric material of the capacitive electrodes use is preferably made of $Ba(Ti_{0.9}Zr_{0.1})O_3$, which is doped with a small quantity of a Mn acceptor, in particular $Mn^{+3}$ acceptor. The permanent internal electric dipoles have a saturation polarization of $P \approx 1.5 \cdot 10^{-5}$ C/cm$^2$. The coercive field strength is $E_c \approx 60$ V/mm. As a result, the product of the saturation polarization P and the effective surface A is $P \cdot A > 10^{-5}$ C, and the product of the coercive field strength $E_c$ and the effective thickness of the dielectric d is $E_c \cdot d < 200$ V for the capacitive electrodes in all examples. The electric breakdown field strength $E_{bd}$ of the dielectric material may also be chosen so that the product $E_{bd} \cdot d < 200$ V. By virtue thereof, the gas discharge lamps can be operated directly at the line current for private households without additional drive electronics. The choice of the dielectric material, however, is not limited to the above-mentioned material. Use can alternatively be made of other dielectric materials, preferably paraelectric materials, ferroelectric materials and antiferroelectric materials, whose product of the saturation polarization P and the effective surface A meets the requirement $P \cdot A > 10^{-5}$ C.

The material for the dielectric must be slightly electron emissive at the surface facing the plasma. The emission properties of the dielectric are characterized by the ratio between ion current and electron current at the surface of the side of the dielectric facing the plasma. This ratio is referred to as ion-induced secondary emission coefficient $\gamma$. To enable operation at line voltage for private households, $\gamma$ should advantageously be greater than 0.001 because the plasma does not ignite at a lower value. Between the dielectric surface and the light-generating part of the plasma, a narrow, approximately 1 mm thick plasma boundary layer is formed. The power delivery in the plasma boundary layer may assume high values, thereby significantly reducing the efficiency (lumen per Watt) of the lamp. A high secondary emission coefficient $\gamma$ leads to a reduction of this power fraction, thereby increasing the efficiency of the lamp. Therefore, materials which can particularly suitably be used for the dielectric are those which demonstrate deposition of additional electrons on the surface facing the plasma during the operation of the lamp, and which lead to a secondary emission coefficient $\gamma>0.01$.

In all conceivable embodiments of the gas discharge lamp, an improvement of the efficiency, or a reduction of the electromagnetic perturbing radiation, can be achieved by choosing the pressure and the filling gas for the lamp so that the electrodes are operated in a non-standard glow mode. As a result, the cathode-drop region provides the entire gas discharge lamp with a positive U/I characteristic.

FIG. 1 shows a capacitive gas discharge lamp comprising a glass tube 1 which serves as the gas discharge vessel. The glass tube 1, the inner surface of which is coated with phosphor, has an inside diameter of 50 mm and is filled with 5 mbar Ar and 5 mg Hg. At both ends of the glass tube 1, a dielectric, capacitive electrode is provided which consists of a disc-shaped dielectric layer 2 and an electroconductive layer 3. The dielectric layer 2 is formed by a disc having a diameter of 5 cm and a thickness of 0.5 mm, which consists of $Ba(Ti_{0.9}Zr_{0.1})O_3$ doped with a small quantity of Mn acceptor. The dielectric layer 2 is attached to the gas discharge vessel 1 by means of soldering, thereby forming a vacuum-tight connection. The electroconductive layer 3 is formed by providing a silver paste, thereby forming an electric contact for connection to an external power line 4. In this example, the external power line 4 is the line for private households (230 V, 50 Hz). When the mains voltage is turned on, the gas discharge of the lamp ignites and a stationary gas discharge is formed. Electrons reach the surface of the dielectric material and adhere thereto. The dielectric (2) is charged during operation of the lamp, which leads to an electric field between the dielectric electrodes (2), as a result of which a simplified re-ignition in the next half phase of the AC voltage supply (after current reversal) and an increase of the ion-induced secondary emission coefficient $\gamma$ take place. As a result thereof, the cathode-drop region (a dark zone in the vicinity of the electrode where no light is generated) is reduced and hence the efficiency of the gas discharge lamp increased.

Figure 2:
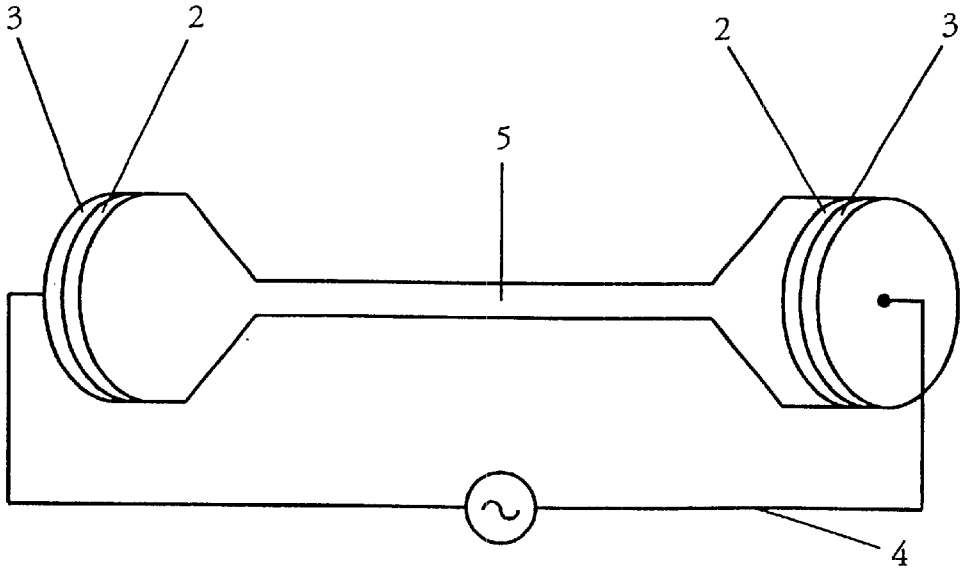
FIG. 2 shows a further embodiment of the gas discharge lamp.

FIG. 2 shows a lamp comprising a glass tube 5 as the gas discharge vessel, which has a smaller inside diameter. The inside diameter is only 9 mm, and the glass tube 5, whose inner surface is coated with phosphor, is filled with 15 mbar Ar and 5 mg Hg. Also in this case, the glass tube 5 is provided at either end with a dielectric electrode consisting of a disc-shaped dielectric layer 2 and an electroconductive layer 3. Here too, the dielectric layer 2 consists of a disc of $Ba(Ti_{0.9}Zr_{0.1})O_3$ doped with a small quantity of Mn acceptor, which disc has a diameter of 5 cm and a thickness of 0.5 mm. The dielectric disc 2 is connected in a vacuum-tight manner to the glass tube 5 by means of a glass solder technique. The electroconductive layer 3 is formed by providing a silver paste, thereby forming an electric contact for connection to an external power line 4. Also in this example, the power for private households (230 V, 50 Hz) is used as the external power line 4. As a result of the smaller inside diameter, this embodiment of the lamp leads to a higher efficiency because the positive column of the gas discharge and the electrode and cathode drop region can be individually optimized.

Figure 3:
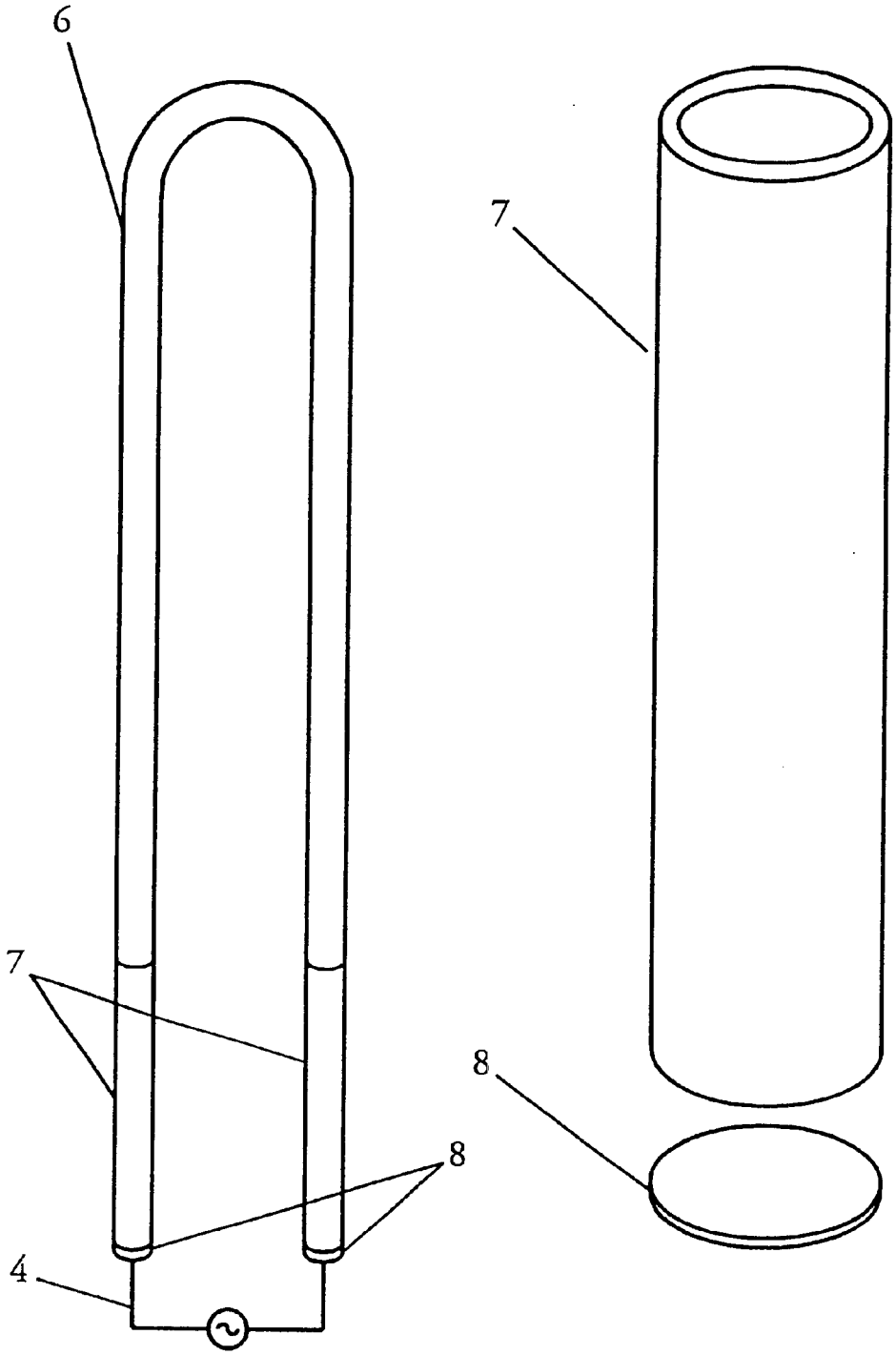
FIG. 3 shows a third embodiment.

The embodiment of the lamp shown in FIG. 3 comprises a discharge vessel consisting of a curved glass tube 6. The glass tube 6, whose inner surface is coated with phosphor, has an inside diameter of 9 mm and is filled with 15 mbar Ar and 5 mg Hg. At either end, the dielectric electrode is formed by a cylindrical tube 7 of the dielectric material (specially doped $BaTiO_3$). The dielectric cylinder 7 has an outside diameter of 10 mm, a wall thickness of 0.5 mm and a length of 60 mm. The glass tube 6 is closed in a vacuum-tight manner by a disc-shaped dielectric cover 8 which is provided by means of soldering. The dielectric cylinder 7 is provided with a layer of conductive silver, enabling electric contact to be made. Through said contact, the lamp is connected to an external power line 4 (230 V, 50 Hz). This gas discharge lamp combines a clearly more compact design and high mechanical stability with a very good luminous efficiency. Of course, other embodiments of the inventive gas discharge lamp are conceivable, particularly as regards the design of the discharge vessel or the choice of the dielectric and electroconductive materials used for the coupling-in structures (for example for meeting certain requirements regarding the shape of the lamp or production-technical data). Moreover, it will be clear that the invention is not limited to lamps whose electromagnetic radiation is limited to the visible spectral range.

What is claimed is:

1. A gas discharge lamp comprising at least one electrode, which is a dielectric having a dielectric saturation polarization P and an effective surface A, with the product of $P \cdot A > 10^{-5}$ C, wherein said at least one electrode is configured for connection to a power source for operation of said gas discharge lamp without drive electronics.

2. A gas discharge lamp as claimed in claim 1, wherein the dielectric has a coercive field strength $E_c$ and an effective thickness d, with the product of $E_c \cdot d < 200$ V.

3. A gas discharge lamp as claimed in claim 2, wherein the dielectric has an electric breakdown field strength $E_{bd}$, with the product of $E_{bd} \cdot d < 200$ V.

4. A gas discharge lamp as claimed in claim 1, characterized in that the dielectric is composed of a paraelectric, ferroelectric or antiferroelectric solid matter.

5. A gas discharge lamp as claimed in claim 1, wherein the dielectric is composed of $Ba(Ti_{1-x}Zr_x)O_3$ with acceptor dopants.

6. A gas discharge lamp as claimed in claim 5, wherein the zirconium content x=0.10.

7. A gas discharge lamp as claimed in claim 5, wherein a dopant with $Mn^{3+}$ forms the acceptor dopant.

8. A gas discharge lamp as claimed in claim 5, wherein the dielectric has an effective surface $A > 0.5$ cm$^2$.

9. A gas discharge lamp as claimed in claim 5, wherein the dielectric has an effective thickness d<5 mm.

10. A gas discharge lamp as claimed in claim 1, wherein the lamp comprises a discharge vessel which is a curved glass tube with two ends and the dielectric is formed as a disc-shaped cover closing said tube in a vacuum-tight manner and as a cylindrical tube within the curved glass tube at at least one of said ends.

11. A gas discharge lamp as claimed in claim 10, wherein the cylindrical tube has a layer of conductive silver.

12. A gas discharge lamp as claimed in claim 1, wherein the lamp comprises a discharge vessel which is a glass tube with a first end and a second end and the dielectric is formed as a disc-shaped cover closing at least one of said ends of the tube in a vacuum-tight manner.

13. A gas discharge lamp as claimed in claim 12, wherein the glass tube comprises a first portion at the first end, a second portion at the second end and an intermediate portion between the first portion and the second portion, said intermediate portion having a diameter less than the diameter of the tube at the first end and the second end.

14. A gas discharge lamp comprising a discharge vessel which is a glass tube with two ends and at least one electrode made of a dielectric material, said dielectric material having a dielectric saturation polarization P and an effective surface A, with the product of $P \cdot A > 10^{-5}$ C and said dielectric material being formed as a disc-shaped cover closing said tube in a vacuum-tight manner, wherein said at least one electrode is configured for connection to a power source for operation of said gas discharge lamp without drive electronics.

15. The discharge lamp of claim 14, wherein the electrode includes an electroconductive layer.

16. The discharge lamp of claim 15, wherein the electroconductive layer is formed from a silver paste.

17. The discharge lamp of claim 15, wherein the electroconductive layer is an electric contact for connection to an external power line.

18. A gas discharge lamp comprising a discharge vessel which is a curved glass tube with two ends and at least one electrode made of a dielectric material, said material having a dielectric saturation polarization P and an effective surface A, with the product of $P \cdot A > 10^{-5}$C and being formed as a disc-shaped cover closing said tube in a vacuum-tight manner and as a cylindrical tube within the curved glass tube, wherein said at least one electrode is configured for connection to a power source for operation of said gas discharge lamp without drive electronics.

19. The discharge lamp of claim 18, wherein the cylindrical tube has a layer of conductive silver.

20. The gas discharge lamp of claim 1, wherein the power source is an alternating current (AC) voltage source, and upon turning on said AC voltage source, said at least one electrode being configured to ignite a gas discharge in the gas discharge lamp to form a stationary gas discharge and an electric field which contributes to re-ignition of the gas discharge in a next half phase of the AC voltage supply.

21. The gas discharge lamp of claim 20, wherein said at least one electrode is configured to increase ion-induced secondary emission coefficient in said next half phase.

22. The gas discharge lamp of claim 14, wherein the power source is an alternating current (AC) voltage source, and upon turning on said AC voltage source, said at least one electrode being configured to ignite a gas discharge in the gas discharge lamp to form a stationary gas discharge and an electric field which contributes to re-ignition of the gas discharge in a next half phase of the AC voltage supply.

23. The gas discharge lamp of claim 22, wherein said at least one electrode is configured to increase ion-induced secondary emission coefficient in said next half phase.

24. The gas discharge lamp of claim 18, wherein the power source is an alternating current (AC) voltage source, and upon turning on said AC voltage source, said at least one electrode being configured to ignite a gas discharge in the gas discharge lamp to form a stationary gas discharge and an electric field which contributes to re-ignition of the gas discharge in a next half phase of the AC voltage supply.

25. The gas discharge lamp of claim 24, wherein said at least one electrode is configured to increase ion-induced secondary emission coefficient in said next half phase.

26. A method for determining size and material of an electrode of a gas discharge lamp, comprising the steps of selecting an electrode material with dielectric saturation polarization P and forming an effective surface A of said material, so that the product of $P \cdot A > 10^{-5}$ C.

27. The method of claim 26 further comprising the step of forming the dielectric material so that the coercive field strength $E_c$ of the dielectric material multiplied by an effective thickness d of the dielectric material are such that the product $E_c \cdot d < 200$ V.

28. The method of claim 27 further comprising the step of forming the dielectric material so that the breakdown field strength $E_{bd}$ of the dielectric material multiplied by the effective thickness d of the dielectric material are such that the product $E_{bd} \cdot d < 200$ V.

* * * * *